US006302755B1

(12) United States Patent
Ferguson et al.

(10) Patent No.: US 6,302,755 B1
(45) Date of Patent: Oct. 16, 2001

(54) TRANSOM SEAL PROVIDING INDEPENDENTLY SECURE DUAL SEALING TO A MARINE PROPULSION SYSTEM

(75) Inventors: Arthur R. Ferguson, Glenview; Stephen R. Johnson, Waukegan, both of IL (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/552,750

(22) Filed: Apr. 19, 2000

(51) Int. Cl.[7] ..... B63H 23/36
(52) U.S. Cl. ..... 440/112
(58) Field of Search ..... 440/111, 112

(56) References Cited

U.S. PATENT DOCUMENTS

| | | | | |
|---|---|---|---|---|
| 3,669,057 | | 6/1972 | Shimanckas . | |
| 3,859,951 | | 1/1975 | Woodfill . | |
| 4,040,378 | * | 8/1977 | Blanchard | 440/112 |
| 4,478,585 | | 10/1984 | Brandt et al. . | |
| 4,940,434 | | 7/1990 | Kiesling . | |

* cited by examiner

*Primary Examiner*—Stephen Avila
(74) *Attorney, Agent, or Firm*—Timothy J. Ziolkowski

(57) ABSTRACT

A transom seal assembly for sealing an opening in a boat transom is provided. A propulsion system has a part thereof extending through the transom opening and the seal assembly is positioned between the part and the transom opening to provide respective individually secure dual watertight seals relative to the interior of the boat.

36 Claims, 3 Drawing Sheets

TRANSOM SEAL PROVIDING INDEPENDENTLY SECURE DUAL SEALING TO A MARINE PROPULSION SYSTEM

BACKGROUND OF THE INVENTION

Boats which are propelled by propulsion systems, such as stern drive systems, commonly have an aperture in the transom through which extends a part of the stern drive system to enable transmission of power from an engine within the boat hull to a propulsion unit positioned rearwardly of the transom. Mounting of the stern drive system through the transom has required a seal to prevent entry of water through the aperture into the boat hull. Various arrangements have been employed in the past for providing a seal between the stern drive and the boat transom to prevent entry of water into the interior of the boat. Unfortunately, it is believed that each of such prior sealing arrangements may be somewhat vulnerable to single failures, that is, if the seal develops a single rupture, the boat could sink. Further, typical seals have involved various parts, such as trims, castings, and screws, and have been relatively burdensome to assemble and to remove when removal is required, as for instance, when removing the stern drive system for repair or replacement.

Thus, it is desirable to provide a seal having structural redundancies that provide independent dual sealing, that is, a seal that would require separate failures of each of the structures that respectively provide independent sealing before the overall transom seal would be compromised. It is further desirable to provide a seal that may be readily assembled during manufacturing operations and that further may be easily removable during servicing or maintenance operations.

SUMMARY OF THE INVENTION

Generally speaking, the present invention fulfills the foregoing needs by providing a boat having a transom including an inner wall and an outer wall defining an opening therein. A stern drive system has a part thereof extending through the transom opening, and a seal is positioned between respective peripheries of the part and the transom opening to respectively provide independent sealing relative to the interior of the boat of the outer and inner walls defining said opening.

The present invention may further fulfill the foregoing needs by providing a transom seal assembly for sealing an opening in a boat transom. A propulsion system has a part thereof extending through the transom opening and the seal assembly is positioned between the part and the transom opening to provide respective individually secure dual watertight seals relative to the interior of the boat.

In another aspect of the present invention, a method for sealing an opening in a boat transom is provided. The opening is configured to allow at least a part of a propulsion system to pass therethrough. The method allows for positioning a seal assembly between the part and the transom opening; and further allows for providing in the seal assembly respective individually secure dual watertight seals relative to the interior of the boat.

Figure 1:
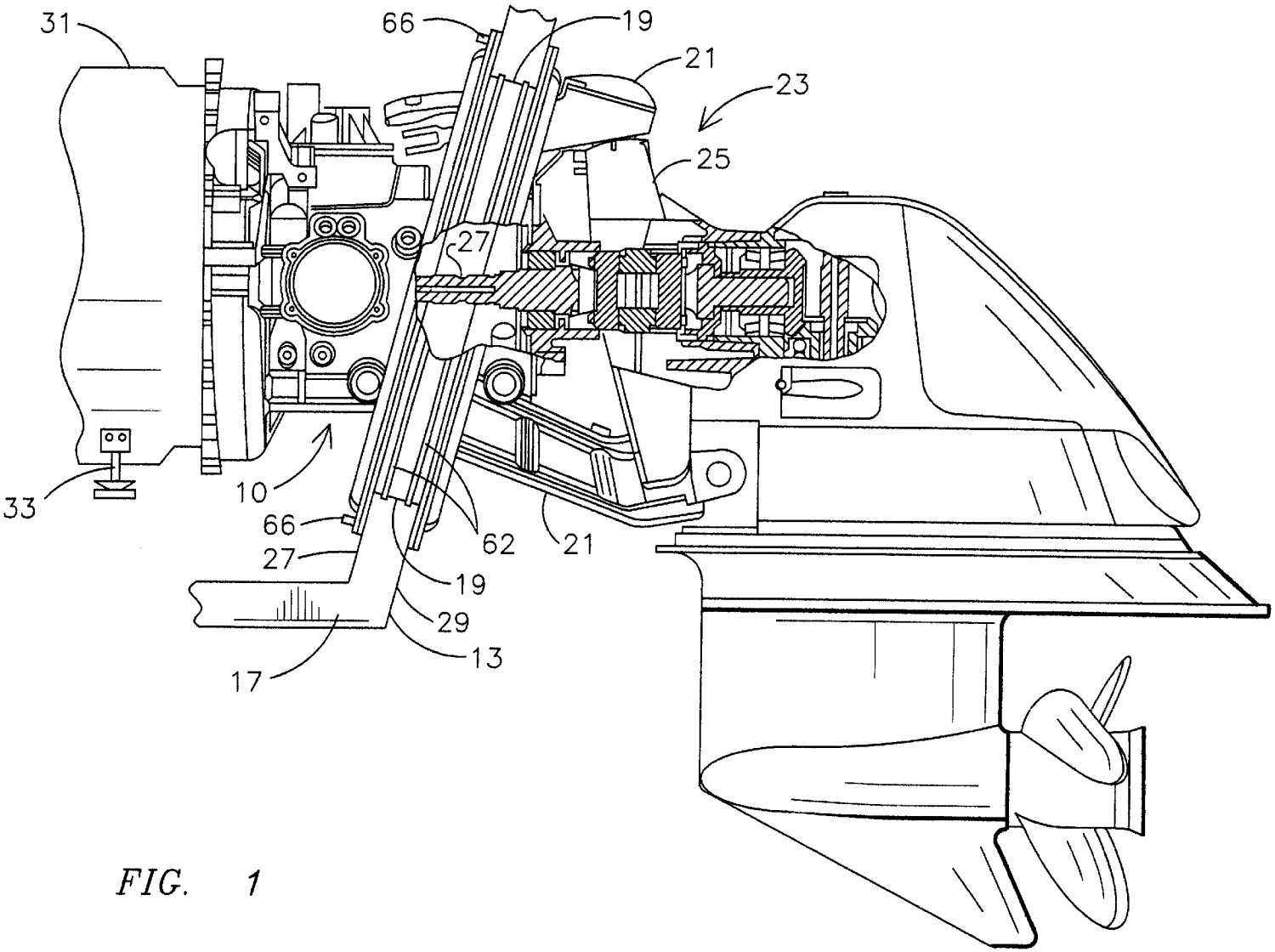
FIG. 1 is a fragmentary elevational side view and partly cross-sectional view of an exemplary marine propulsion that uses a transom seal assembly embodying the present invention.

Before any embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE INVENTION

Shown in the drawings is an exemplary seal assembly 10 embodying various of the features of the present invention for sealing the transom 13 of a boat 17 against the entry of water through an aperture or opening 19 through which extends a part 21 of a stern drive system 23. More particularly, FIG. 1 shows a fragmentarily illustrated boat 17 having a hull with a transom 13 and including therein means defining an aperture 19 which may be oval but could have other shapes, such as circular, and which is circumscribed by wall boundaries 27 and 29 located on the inner and outer surfaces, respectively, of the transom 13. The boat 17 is adapted to be propelled in the water by stern drive system 23 including an engine 31 which is located in the boat hull forwardly of the transom 13 and which can be mounted on the boat hull by supporting means 33 independent of the sealing arrangement. Connected to the engine 31 or forming a portion thereof is a part 21 of the stern drive system 23 which extends through the aperture 19 to the rear of the transom 13 for connection to other components which extend into the water and provide both for propulsion and steering. The part 21 can be a housing for a gimbal unit 25 and/or a rearwardly extending drive shaft 27 or other components of the stern drive system and, by way of example, may have an oval-shaped outer periphery.

Figure 3:
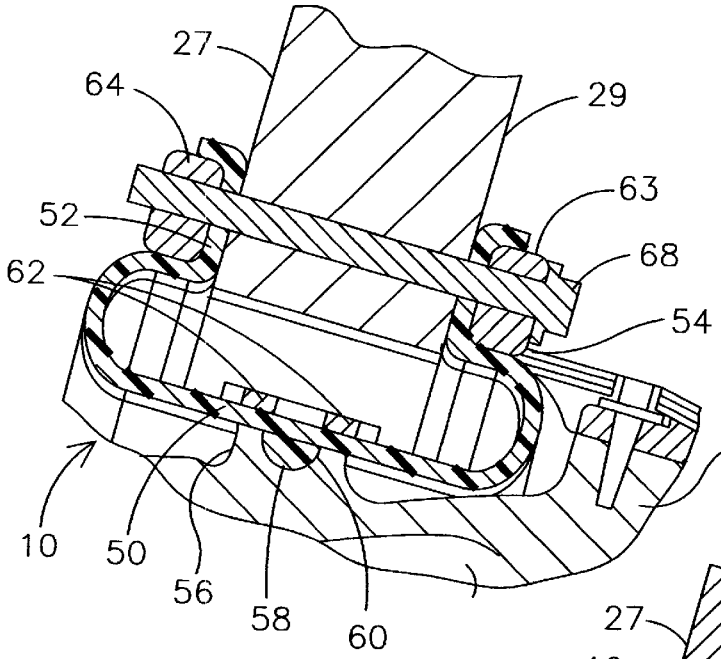
FIG. 3 is a more detailed view of the cross-sectional view shown in FIG. 2.
Figure 2:
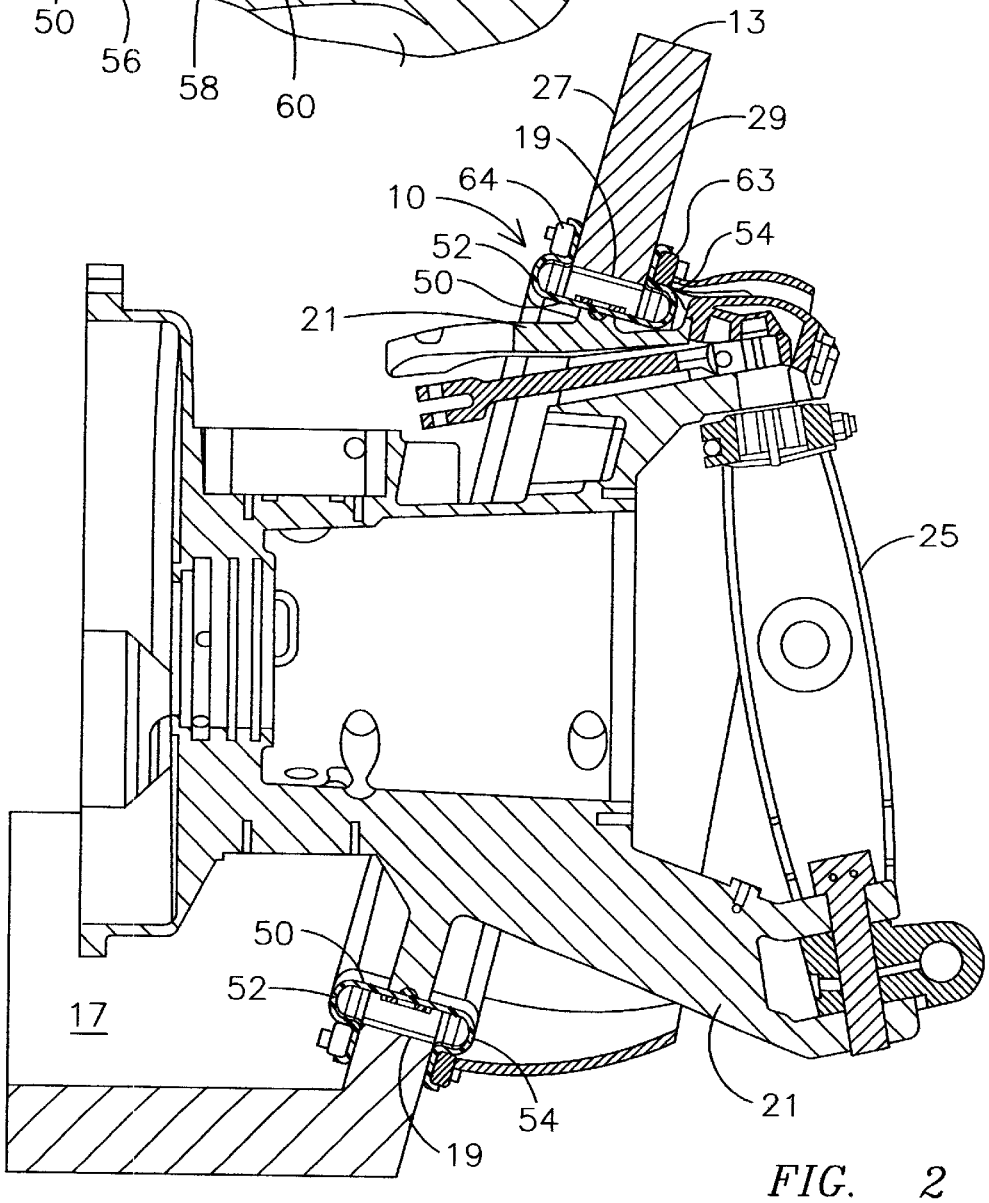
FIG. 2 in part illustrates a cross-sectional view of the seal assembly shown in FIG. 1.

As shown in FIG. 2 and best appreciated in FIG. 3, seal 10 comprises a generally U-shaped seal having a base 50 and two legs 52 and 54. As suggested above, one key advantage of the sealing arrangement of the present invention is that each leg 52 and 54 provides an independent or redundant seal relative to the interior of the boat. Part 21 may include at its outer periphery an ovally-shaped flange 56 with a groove 58 that circumferentially extends along that periphery of part 21. An outer section of base 50, such as may be located at the center of that base, includes a circumferentially extending bead 60 shaped to engage groove 58 in the flange in part 21. A pair of relatively narrow straps 62 (FIG. 1) including respective tab ends with suitable openings may be clamped together using standard fastening means, (not shown) such as screws and nuts around the transom seal, or worm-gear clamps, such as are typically used in hoses for automotive applications. It will be appreciated that the respective grip provided by straps 62 allows for sealingly securing the portion of the transom seal located on respective sides of bead 60 that engage groove 58 in part 21. Straps 62 further allow for securely maintaining engagement between groove 58 and bead 60 notwithstanding of surface irregularities that may occur therebetween. Alternatively, in lieu of a pair of relatively narrow straps, a single wider band could be used for sealingly securing bead 60 to groove 58.

Figure 4:
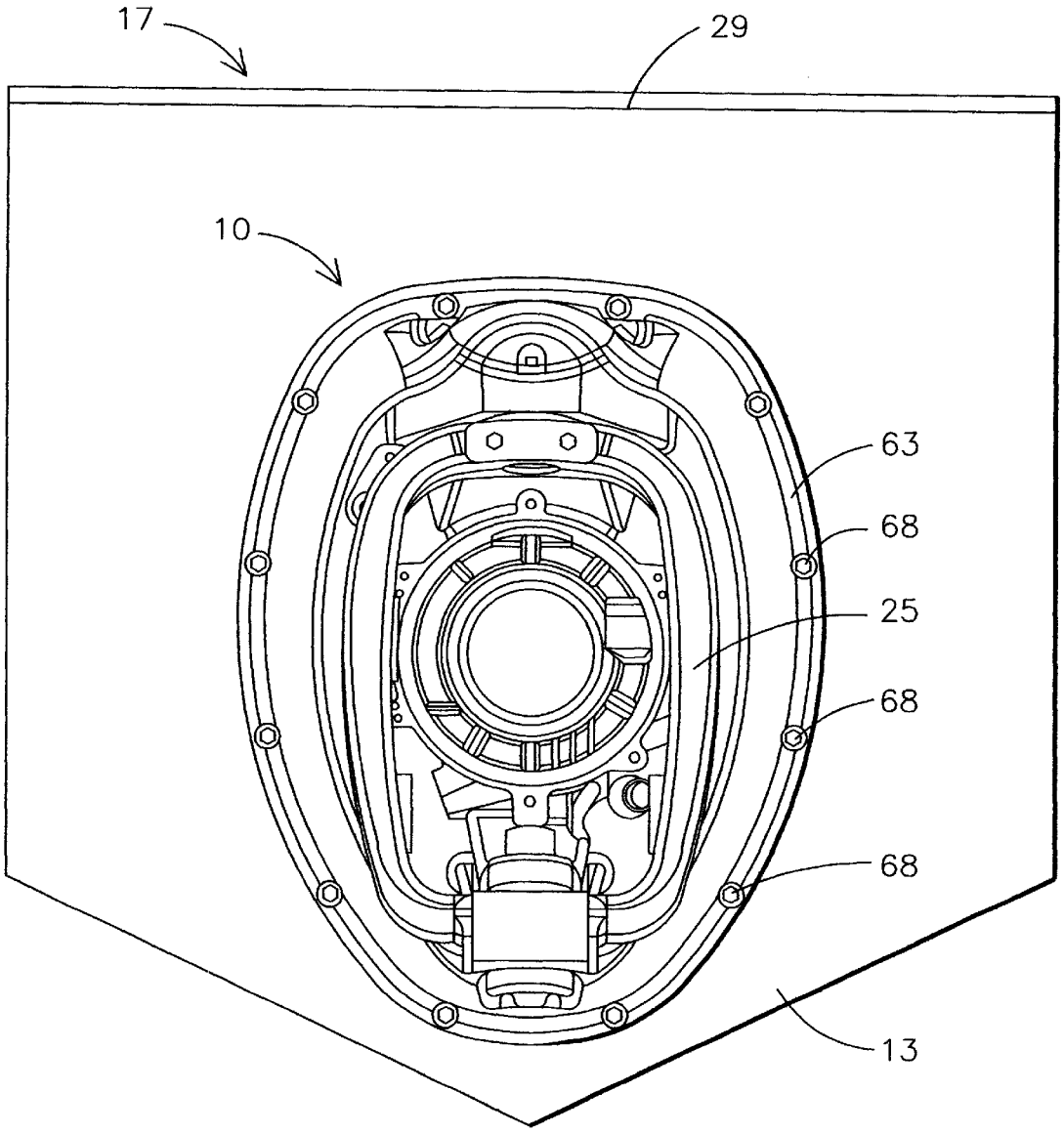
FIG. 4 is an elevational rear view of the seal assembly of the present invention.

Sealing arrangement 10 further comprises an outer transom ring 63 for sealingly engaging one of the two legs, e.g., leg 54, to one of the wall boundaries defining the transom opening, e.g., outer wall 29. The shape of outer ransom ring may be oval-shaped, as best appreciated in FIG. 4. Further, if desired a decorative cover may be installed onto the outer ring to provide an aesthetically pleasing visual appearance to viewers. Similarly, an inner transom ring 64 is provided for sealingly engaging the other leg, e.g., leg 52, to the other wall boundary, e.g., inner wall 27.

As best seen in FIG. 1, seal 10 may further comprise a plurality of integrally-constructed locator or guide pins 66 for quickly locating respective sets of openings that receive fastening means 68, such as screws or bolts, for fastening on the respective outer and inner walls of the transom the respective outer and inner rings 63 and 64 and seal 10 to one another. During assembly operations, preferably the transom seal is initially installed on part 21, e.g., the gimbal housing, before the stern drive is installed in the boat.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A boat having a transom including an inner wall and an outer wall defining an opening therein, a stern drive system having a part thereof extending through the transom opening, and a seal positioned between respective peripheries of the part and the transom opening to respectively provide, relative to the interior of the boat, independent sealing to the outer and inner walls defining said opening, wherein the seal comprises a base and two legs, the seal incorporating a bead extending circumferentially from the base.

2. The boat of claim 1 wherein the base and two legs define a generally U-shaped seal.

3. The boat of claim 1 wherein the circumferentially extending bead is configured along an outer section of the base.

4. The boat of claim 3 wherein the part extending through the transom has a groove configured to receive the circumferentially extending bead.

5. The boat of claim 4 further comprising first and second straps circumferentially extending along the inner section of the base for sealingly clamping opposite sides of the bead relative to the groove.

6. The boat of claim 5 further comprising a set of fasteners positioned to fasten the first and second straps.

7. The boat of claim 5 further comprising a band circumferentially extending along the inner section of the base for sealingly clamping the bead relative to the groove.

8. The boat of claims 7 further comprising fastening means for fastening the band.

9. The boat of claim 5 wherein one of the two legs engages the outer wall of the transom and the other one of the two legs engages the inner wall of the transom.

10. The boat of claim 9 further comprising an outer ring for sealingly engaging said one of the legs of the seal to the outer wall of the transom and an inner ring for sealingly engaging said other one of the legs of the seal to the inner wall of the transom to independently provide a dual seal relative to the interior of the boat.

11. The boat of claim 10 further comprising fastening means for fastening on the respective walls of the transom the respective rings, and the seal to one another.

12. The boat of claim 10 wherein the seal further comprises guide pins to align respective sets of apertures on the rings and the seal for receiving the fastening means.

13. A transom seal assembly for sealing an opening therein, a propulsion system having a part thereof extending through the transom opening, the seal assembly having a base and two legs defining a generally U-shaped seal and positioned between the part and the transom opening; and an outer ring seal engaging one of the two legs to an outer wall of the transom and the other one of the two legs to an inner wall of the transom to provide respective individually secure dual water tight seals relative to the interior of the boat.

14. A transom seal assembly for sealing an opening therein, a propulsion system having a part thereof extending through the transom opening, the seal assembly being positioned between the part and the transom opening to provide respective individually secure dual watertight seals relative to the interior of the boat, the seal assembly comprising:

a base and two legs; and a circumferentially extending bead configured along an outer surface of the base.

15. The seal assembly of claim 14 wherein the base and two legs define a generally U-shaped seal.

16. The seal assembly of claim 14 wherein the part extending through the transom has a groove configured to receive the circumferentially extending bead.

17. The seal assembly of claim 16 further comprising first and second straps circumferentially extending along the inner section of the base for sealingly clamping opposite sides of the bead relative to the groove.

18. The seal assembly of claim 17 further comprising a set of fasteners configured to fasten the first and second straps.

19. The seal assembly of claim 16 further comprising a band circumferentially extending along the inner section of the base for sealingly clamping the bead relative to the groove.

20. The seal assembly of claim 16 further comprising fastening means for fastening the band.

21. The seal assembly of claim 17 wherein one of the two legs engages an outer wall of the transom and the other one of the two legs engages an inner wall of the transom.

22. The seal assembly of claim 21 further comprising an outer ring for sealingly engaging said one of the legs of the seal to the outer wall of the transom and an inner ring for sealingly engaging said other one of the legs of the seal to the inner wall of the transom to independently provide a dual seal relative to the interior of the boat.

23. The seal assembly of claim 22 further comprising fastening means for fastening on the respective walls of the transom the respective rings, and the seal to one another.

24. The seal assembly of claim 23 wherein the seal further comprises guide pins to align respective sets of apertures on the rings and the seal for receiving the fastening means.

25. The seal assembly of claim 14 wherein the propulsion system comprises a stern drive system.

26. A method for sealing an opening in a boat transom, the opening being to allow at least a part of a propulsion system to pass therethrough, the method comprising:

positioning a seal assembly having a base and at least two legs between the part and the transom opening, the seal assembly further including a circumferentially extending bead along an outer section of the base; and providing in the seal assembly respective individually secure dual watertight seals relative to the interior of the boat.

27. The method of claim 26 further comprising configuring the part extending through the transom to include a groove for receiving the circumferentially extending bead.

28. The method of claim 27 further comprising sealingly clamping opposite sides of the bead relative to the groove using first and second straps circumferentially extending along the inner section of the base.

29. The method of claim 28 further comprising fastening the first and second straps.

30. The method of claim 27 further comprising sealingly clamping the bead relative to the groove using a band circumferentially extending along the inner section of the base.

31. The method of claim 30 further comprising fastening the band.

32. The method of claim of claim 26 further comprising engaging one of the two legs to an outer wall of the transom and the other one of the two legs to an inner wall of the transom.

33. The method of claim 32 further comprising respectively sealingly engaging said one of the legs of the seal to the outer wall of the transom and the other one of the legs of the seal to the inner wall of the transom to independently provide a dual seal relative to the interior of the boat.

34. The method of claim 33 further comprising fastening on the respective walls of the transom the respective rings, and the seal to one another.

35. The method of claim 34 aligning respective sets of apertures on the rings and the seal for receiving the fastening means, this aligning step being aided through the use of guide pins extending from the seal assembly.

36. A transom seal assembly for sealing an opening therein, a propulsion system having a part thereof extending through the transom opening, the seal assembly having a base and two legs and wherein the outer section of the base includes a circumferentially extending bead, the seal assembly being positioned between the part and the transom opening to provide respective individually secure dual water tight seals relative to the interior of the boat.

* * * * *